US012668443B2

(12) United States Patent
Ramos Negron et al.

(10) Patent No.: US 12,668,443 B2
(45) Date of Patent: Jun. 30, 2026

(54) TRAY TO HOLD SHEET MEDIA FOR PRINTING

(71) Applicant: Hewlett-Packard Development Company, L.P., Spring, TX (US)

(72) Inventors: Juan David Ramos Negron, Vancouver, WA (US); Emma Frances Kelp-Stebbins, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 180 days.

(21) Appl. No.: 18/034,146

(22) PCT Filed: Oct. 29, 2020

(86) PCT No.: PCT/US2020/057968
§ 371 (c)(1),
(2) Date: Apr. 27, 2023

(87) PCT Pub. No.: WO2022/093233
PCT Pub. Date: May 5, 2022

(65) Prior Publication Data

US 2023/0382665 A1 Nov. 30, 2023

(51) Int. Cl.
*B65H 3/06* (2006.01)
*B65H 1/04* (2006.01)
(Continued)

(52) U.S. Cl.
CPC ..... *B65H 3/0607* (2013.01); *B65H 1/04* (2013.01); *B65H 1/266* (2013.01); *B65H 3/56* (2013.01); *B65H 1/08* (2013.01); *B65H 2403/41* (2013.01); *B65H 2405/11162* (2013.01); *B65H 2405/1132* (2013.01); *B65H 2405/1134* (2013.01)

(58) Field of Classification Search
CPC ... B65H 1/04; B65H 1/08; B65H 1/14; B65H 3/0607; B65H 3/34; B65H 3/56; B65H 9/06; B65H 2403/41; B65H 2403/513; B65H 2403/5333; B65H 2404/725; B65H 2405/11162; B65H 2405/113;
(Continued)

(56) References Cited

U.S. PATENT DOCUMENTS 5,746,528 A 5/1998 Mayer et al.
6,824,133 B2 11/2004 Richtsmeier
(Continued)

FOREIGN PATENT DOCUMENTS

JP 58144036 A * 8/1983 ..... B65H 7/18
JP 10087093 A * 4/1998 ..... B65H 3/46
(Continued)

*Primary Examiner* — Prasad V Gokhale
(74) *Attorney, Agent, or Firm* — Foley & Lardner LLP

(57) ABSTRACT

In one example, a tray to hold sheet media for printing includes: a movable support to support a downstream part of a stack of media sheets in the tray; a barrier near a downstream end of the support, the barrier movable between a closed position in which, when a stack of media sheets is on the support, the barrier blocks a downstream end of the stack and an open position in which, when a stack of media sheets is on the support, the barrier does not block a downstream end of at least part of the stack; and an actuator configured to move the barrier from the closed position to the open position.

14 Claims, 6 Drawing Sheets

(51) Int. Cl.
*B65H 1/26* (2006.01)
*B65H 3/56* (2006.01)
*B65H 1/08* (2006.01)

(58) Field of Classification Search
CPC .... B65H 2405/1132; B65H 2405/1134; B65H 2405/1136
See application file for complete search history.

(56) References Cited

U.S. PATENT DOCUMENTS

| | | | | |
|---|---|---|---|---|
| 8,167,300 | B1 | 5/2012 | Blair et al. | |
| 8,256,762 | B2 | 9/2012 | Blair et al. | |
| 8,585,037 | B1 | 11/2013 | Jacobs | |
| 9,233,807 | B2 | 1/2016 | Lo et al. | |
| 2002/0175462 | A1* | 11/2002 | Sonoda | B65H 3/0607 271/121 |
| 2010/0220126 | A1 | 9/2010 | King et al. | |
| 2011/0156339 | A1* | 6/2011 | Nakano | B65H 1/266 271/145 |
| 2013/0120810 | A1* | 5/2013 | Omori | B65H 3/46 271/19 |
| 2017/0166411 | A1 | 6/2017 | Kawarago et al. | |
| 2020/0310320 | A1* | 10/2020 | Nakata | H04N 1/00795 |

FOREIGN PATENT DOCUMENTS

| | | | |
|---|---|---|---|
| KR | 10-2017-0069166 | A | 6/2017 |
| WO | 2019/089037 | A1 | 5/2019 |
| WO | 2020/096624 | A1 | 5/2020 |

* cited by examiner

TRAY TO HOLD SHEET MEDIA FOR PRINTING

BACKGROUND

Some printers print on sheets of paper and other print media. Each sheet is picked from the top of a stack of sheets held in the input tray and fed to the print engine for printing. In some sheet printers, the input tray includes a "lift" plate that supports the downstream part of the stack. When initiating a printing operation, the lift plate raises the stack toward a pick mechanism that picks the top sheet for printing. After each sheet is picked, the lift plate and the stack return to a position away from the pick mechanism to await the next pick.

DRAWINGS

FIGS. 4 and 5 are top down plan views showing a portion of the tray in FIGS. 2 and 3, respectively, in more detail.

FIGS. 6 and 7 are bottom up isometric views showing a portion of the tray in FIGS. 2 and 3, respectively, in more detail.

FIG. 8 is a partial section viewed along the line 8-8 in FIG. 2 with a sheet stack in the tray.

FIG. 10 is a partial section viewed along the line 10-10 in FIG. 3 with a sheet stack in the tray.

The figures are not necessarily to scale. The same part numbers designate the same or similar parts throughout the figures.

DESCRIPTION

A barrier may be used to block the downstream end of the stack of media sheets in an input tray from moving too far into the printer, for example when a stack of sheets is loaded into the tray. The barrier should block the stack when the lift plate is lowered and the stack is away from the pick position, but not block the stack when the lift plate is raised and the stack is in a pick position so that the top sheet may be picked for printing. For a removable input tray, it may be desirable to have a barrier that also blocks the stack when the tray is removed from the printer, for example to prevent the stack from sliding out of the tray and to block a new stack from being loaded too far into the tray.

A new barrier system has been developed for a removable lift plate type sheet media input tray that provides the desired blocking functions when the tray is installed in the printer and when the tray is removed from the printer. In one example, the tray includes a lift plate and a barrier mounted at the downstream end of the lift plate. The barrier is movable between a closed position blocking the end of a stack on the lift plate and an open position not blocking the end of the stack. The tray also includes an actuator that moves the barrier from the closed position to the open position when the lift plate is raised to a pick position in the printer, returns the barrier to the closed position when the lift plate is lowered away from the pick position, and keeps the barrier in the closed position anytime the lift plate is not raised to the pick position including when the tray is removed from the printer.

This and other examples described herein and shown in the figures illustrate but do not limit the scope of the patent, which is defined in the Claims following this Description.

As used in this document: "and/or" means one or more of the connected things; "rotate" means to turn about an axis; and "translate" means to move along a line.

Figure 1:
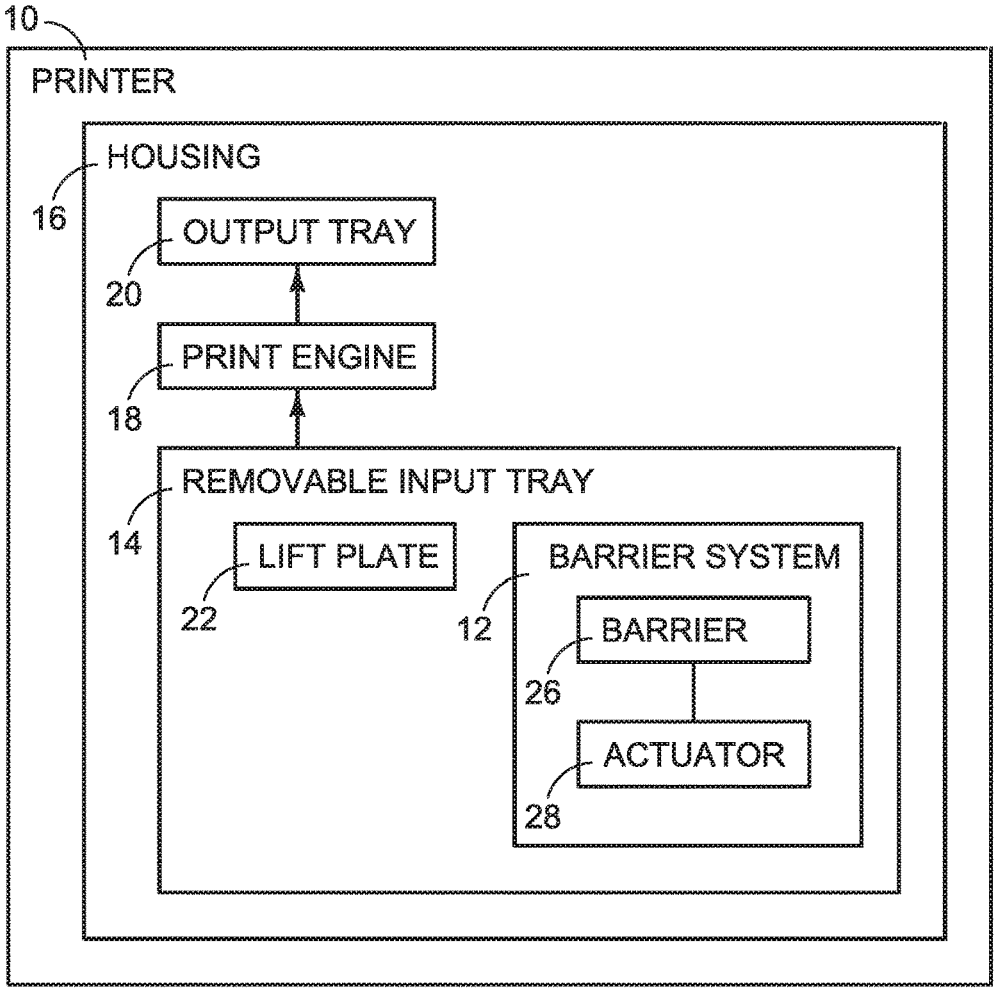
FIG. 1 illustrates a printer implementing an example barrier system for a removable sheet media input tray.

FIG. 1 illustrates a printer 10 implementing an example barrier system 12 for a removable sheet media input tray 14. Referring to FIG. 1, printer 10 includes a housing 16 housing input tray 14, an inkjet, laser or other type print engine 18, and an output tray 20. Print media sheets are picked from the top of a stack of media sheets in input tray 14, fed to print engine 18 for printing, and discharged to output tray 20. Input tray 14 is removable from printer 10, for example to change or reload sheet media. Input tray 14 includes a lift plate 22 that supports the downstream part of a stack of sheets in tray 14. During printing, lift plate 22 is raised from its resting position, where the top of the stack is away from the pick mechanism, to a pick position to present the top sheet in the stack to the pick mechanism for feeding to print engine 18. Lift plate 22 is lowered to the resting position with the stack away from the pick mechanism after each pick or group of multiple picks to await the next pick.

Input tray 14 also includes a barrier system 14 to block the downstream end of the stack when lift plate 22 is lowered and not block the end of the stack, or at least not block the top sheet in the stack, when lift plate 22 is raised so that the top sheet may be picked for printing. Barrier system 14 in FIG. 1 includes a barrier 26 and an actuator 28. Barrier 26 is located near a downstream end of lift plate 22. Actuator 28 is operatively connected to barrier 26 and configured to move barrier 26 between a closed position completely blocking the downstream end of a stack on lift plate 22 and an open position not blocking at least the top sheet on the stack. In one example, actuator 28 is configured to move barrier 26 to an open position when lift plate 22 is moved to a pick position.

FIGS. 2-10 illustrate a removable input tray 14 implementing an example barrier system 14 such as might be used in a printer 10 shown in FIG. 1. Referring to FIGS. 2-8, in this example tray 14 includes a stationary platform 30 with sidewalls 32 and a lift plate 22 with sidewalls 34. Lift plate 22 is connected to platform 30 at pivots 36 so that lift plate 22 can rotate with respect to platform 30. (The far side pivot 36 is not visible in the figures.) Tray 14 also includes a barrier system 14 configured to block the downstream end 38 of a stack 40 of media sheets 42 in tray 14 when lift plate 22 is lowered, and to not block the end 38 of stack 40, or at least not block the top sheet 44 in stack 40, when lift plate 22 is raised so that top sheet 44 may be picked for printing.

Figure 2:
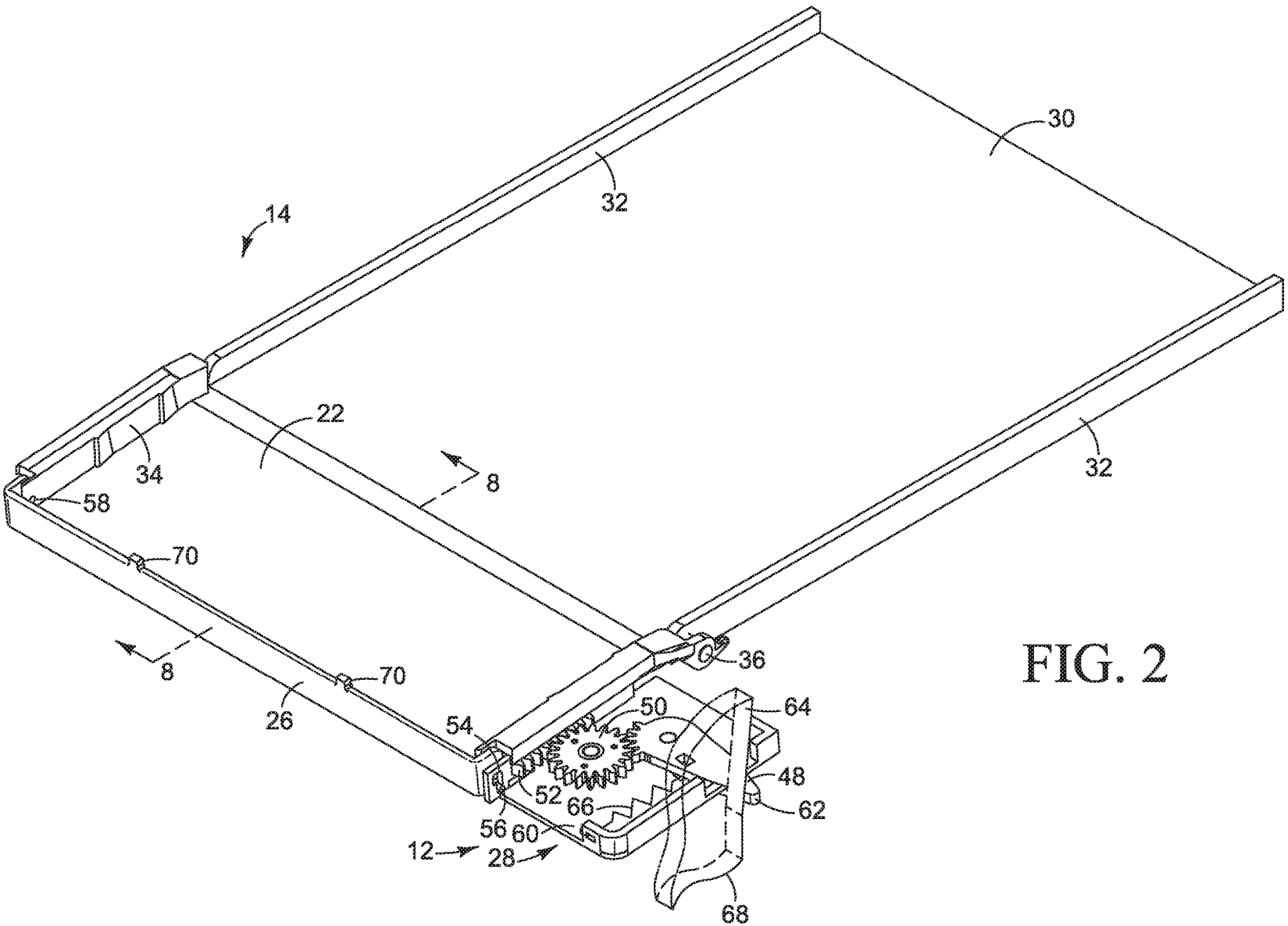
FIGS. 2-10 illustrate a removable sheet media input tray implementing an example barrier system such as might be used in the printer shown in FIG. 1.
Figure 3:
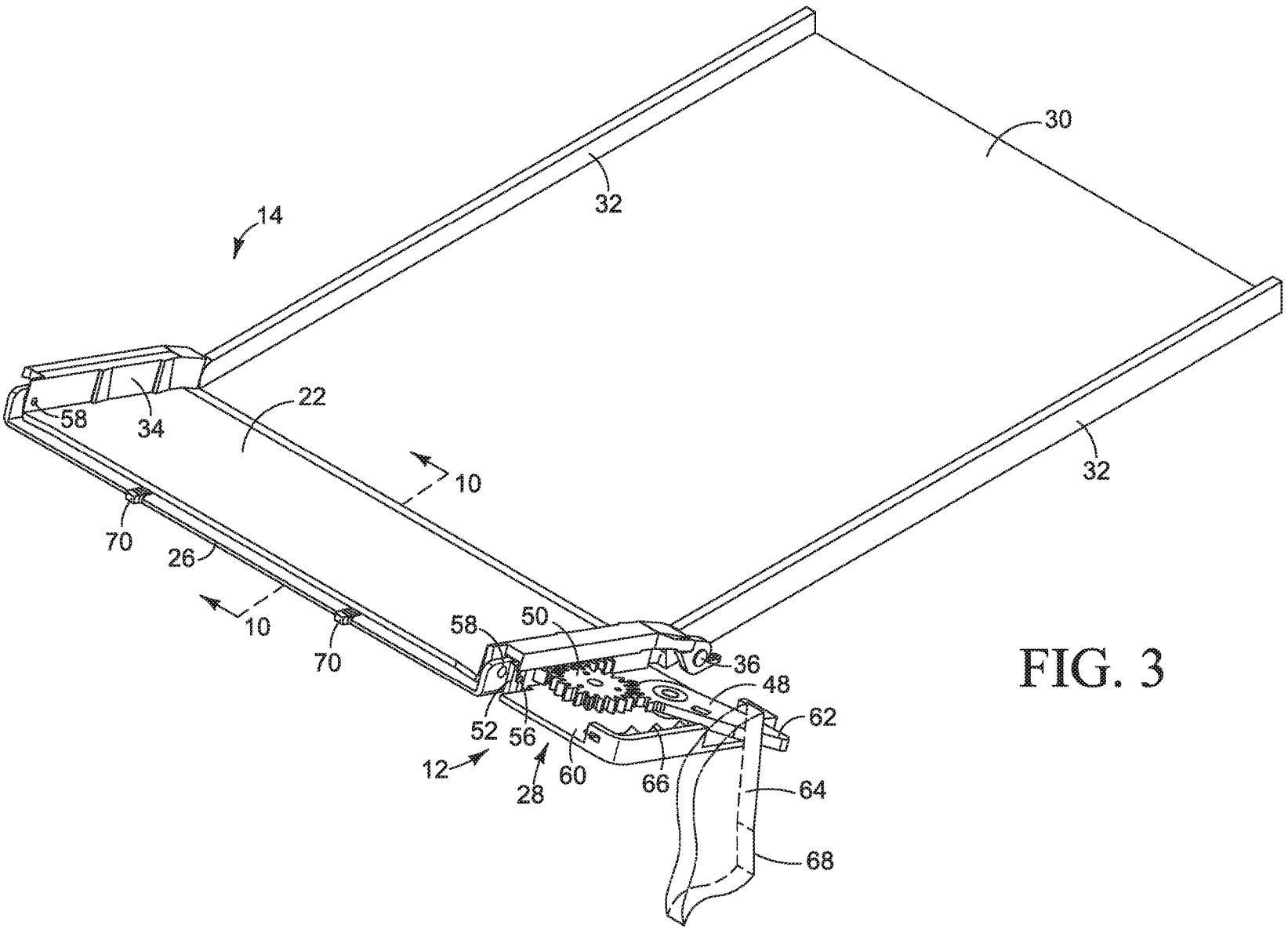

Tray 14 is empty in FIGS. 2 and 3 to better show structural features of the tray. A stack 40 of media sheets 42 is loaded in tray 14 in FIGS. 8-10. FIGS. 2, 4, 6, and 8 show tray 14 with lift plate 22 lowered, away from a pick position. FIGS. 3, 5, 7, 9, and 10 show tray 14 with lift plate 22 raised to a pick position. Any suitable mechanism may be used to raise and lower lift plate 22, such as those commonly used in sheet printers. Any suitable mechanism may be used to pick top sheet 44 from stack 40, such as those commonly used in sheet printers and may include, for example, a pick roller 46 shown in FIGS. 8-10.

Figure 7:
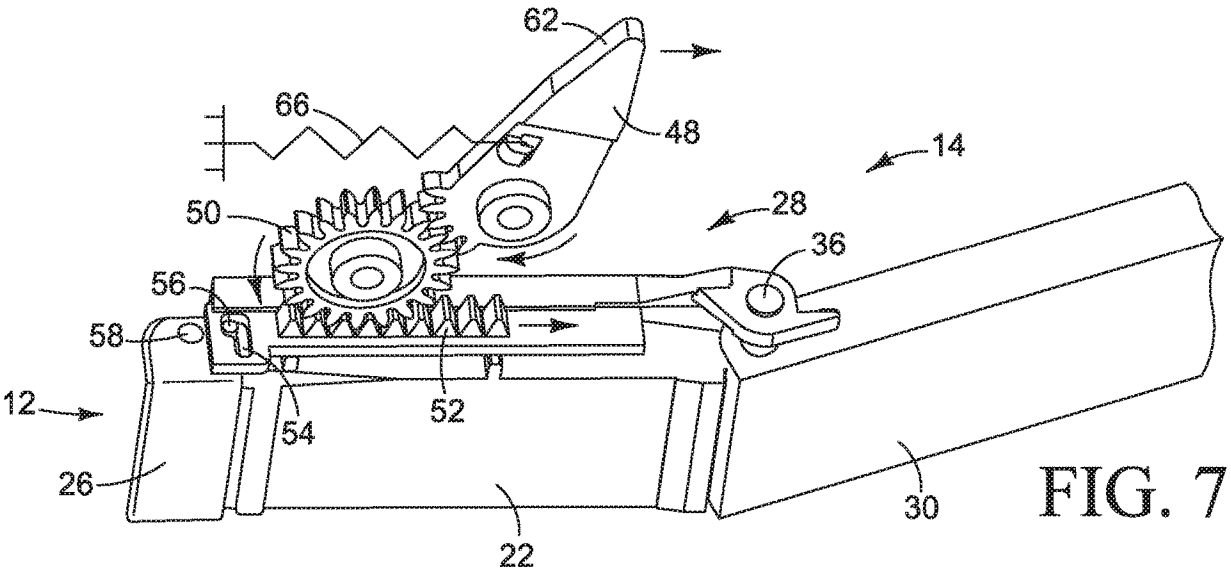

In the example shown in FIGS. 2-10, barrier system 14 includes a barrier 26 and an actuator 28. Barrier 26 is located near the downstream end of lift plate 22. Actuator 28 is operatively connected to barrier 26 and configured to move barrier 26 between a closed position shown in FIGS. 2, 4, 6, and 8 and an open position shown in FIGS. 3, 5, 7, 9, and 10. As shown in FIGS. 2-7, actuator 28 includes a lever 48, a pinion 50 that turns when lever 48 pivots, a rack 52 that translates when pinion 50 turns, as indicated by direction arrows in FIGS. 3, 5, and 7. Actuator 28 also includes a pin 56 protruding from the end of barrier 26 into an inverted L shaped slot 54 in rack 52. Pin 56 in slot 54 traverses a curved path when rack 52 translates, to rotate barrier 26 on pivots 58. Barrier 26 is connected to lift plate 22 at pivots 58 so that barrier 26 can rotate with respect to lift plate 22. As best seen in FIG. 7, pin 56 is spaced apart from pivot 58 to form a moment arm that allows the moving pin 56 to rotate barrier 26.

Figure 5:
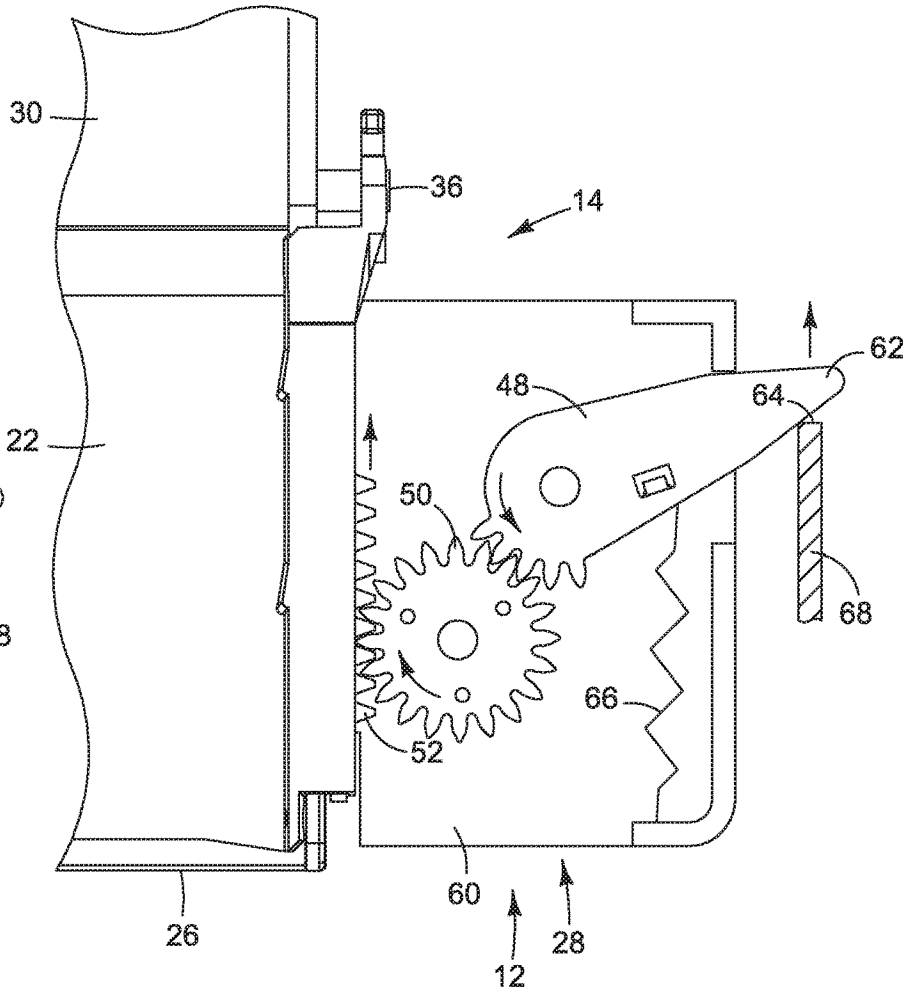
Figure 4:
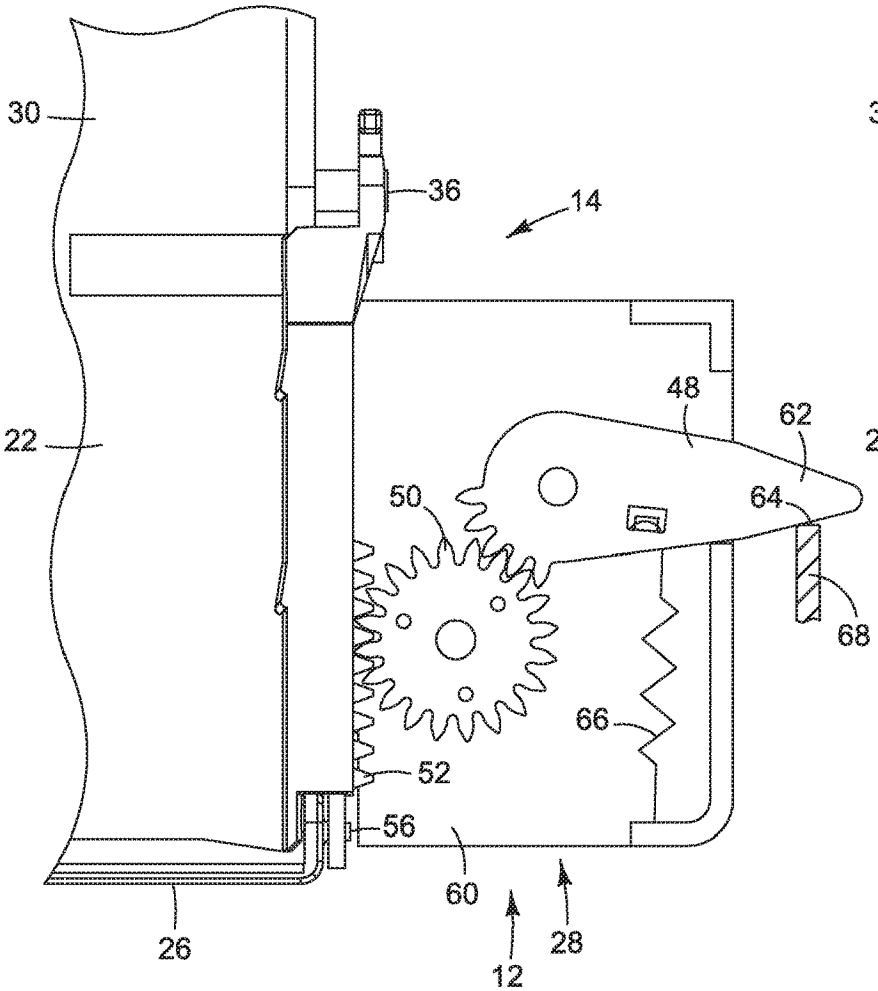
Figure 6:
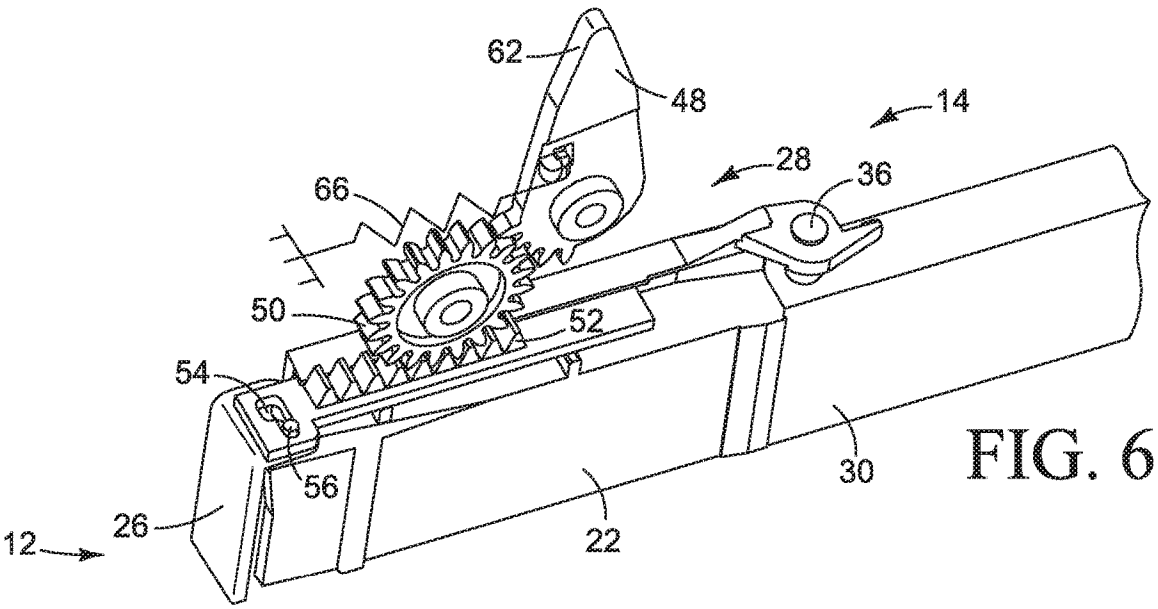
Figure 8:
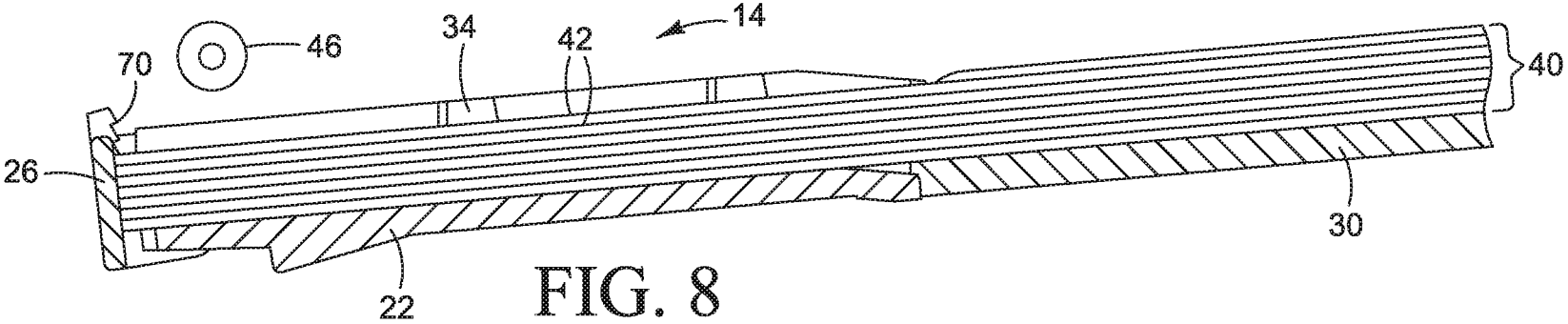
Figure 9:
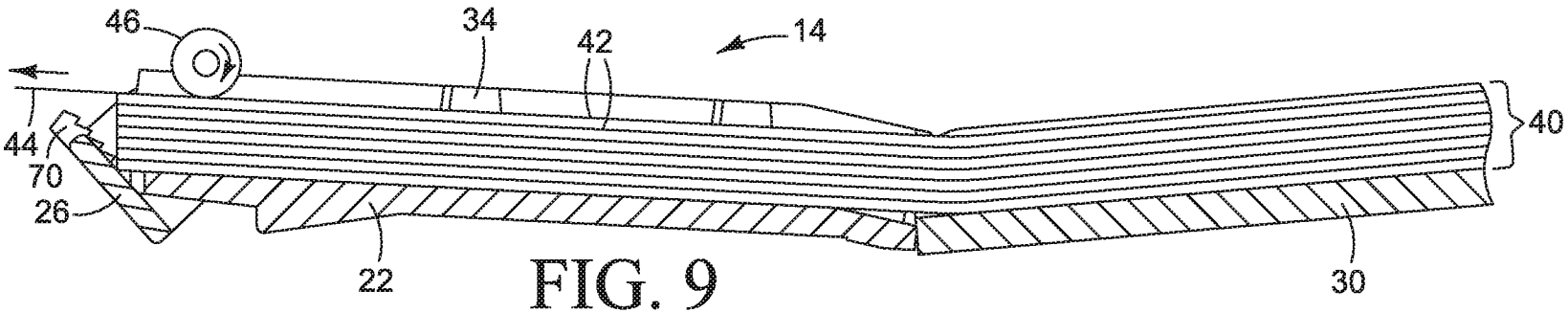

As shown in FIGS. 2-5, lever 48, pinion 50, and rack 52 are mounted to a deck 60 connected to lift plate 22. FIGS. 4 and 5 are plan views with respect to deck 60. Deck 60 is omitted from the bottoms up view of FIGS. 6 and 7 to show parts that would otherwise be hidden behind the deck. When lift plate 22 is raised to a pick position, deck 60 and thus lever 48 move up with lift plate 22, as best seen by comparing FIGS. 2 and 3. The end 62 of lever 48 moves along a stationary driver 64 to pivot lever 48 from the "barrier closed" position shown FIGS. 2, 4, 6, and 8 to the "barrier open" position shown in FIGS. 3, 5, 7, and 10. The pivoting lever 48 turns pinion 50. The turning pinion 50 translates rack 52 which moves pin 56 in slot 54 simultaneously up and over to rotate barrier 26 to the open position shown in FIGS. 3, 5, 7, and 10. FIGS. 3, 5, 7, and 10 show barrier 26 in a fully open position. FIG. 9 shows barrier 26 in a partially open position.

The motion is reversed when lift plate 22 is lowered away from a pick position. In this example, actuator 28 also includes a spring or other suitable biasing mechanism 66 that urges lever 48 and thus barrier 26 toward the closed position shown in FIGS. 2 and 6. When lift plate 22 is lowered away from a pick position, spring 66 pivots lever 48 to turn pinion 50 to translate rack 52 back, right to left in the figures, which moves pin 56 in slot 54 simultaneously down and over (to the left) to rotate barrier 26 to the closed position shown in FIGS. 2, 4, 6, and 8.

As shown in FIGS. 2-5, driver 64 may be implemented, for example, as a ramp integrated into a sidewall 68 along tray 14. Just a portion of sidewall 68 is shown and in outline form (depicted with phantom lines) to not obscure parts that would otherwise be hidden by the sidewall. In an example, sidewall 68 is part of the printer housing (e.g., housing 16 in FIG. 1). A "ramp" in this context means a contact surface that is sloped with respect to lever 48 and may include, for example, a straight surface as shown in the figures and/or a curved surface. Actuator 28 with a stationary driver such as ramp 64 utilizes the motion of lift plate 22 to automatically move lever 48 and thus barrier 26 to an open position when lift plate 22 is raised to a pick position. Also, in this example, the end 62 of lever 48 is tapered to increase the extent of travel and thus the angle through which the lever pivots as it rides up along ramp 64.

Figure 10:
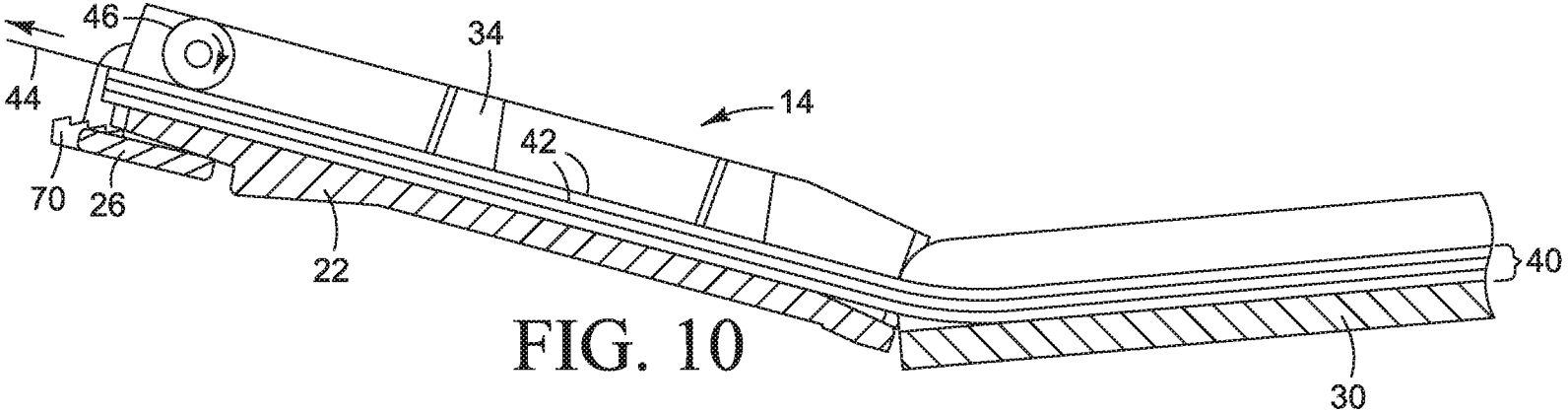

The example configuration for an actuator 28 with ramp 64 shown in FIGS. 2-7 automatically adjusts the distance that lever 48 is moved according to the angle lift plate 22 is raised to reach a pick position. For example, if the location of pick roller 46 is fixed, as shown in FIGS. 8-10, then lift plate 22 will rotate through a larger or smaller angle depending on the thickness of stack 40. Lift plate will rotate through a smaller angle for a thicker stack 40 compared to a thinner stack 40 because the top sheet in a thicker stack will reach pick roller 46 before the top sheet in a thinner stack, as seen by comparing FIGS. 9 and 10. Therefore, barrier 26 is automatically moved to one of a continuum of multiple open positions according to a corresponding continuum of multiple pick positions for lift plate 22, including partially open positions in which barrier 26 blocks progressively less and less of the tray as the stack shrinks.

In the example shown, barrier 26 extends continuously all the way across the end of lift plate 22. In other examples, a segmented barrier 26 could be used, with the segments operatively connected to move together between open and closed positions. Also in the example shown, barrier 26 includes serrated parts 70 to help block sheets in stack 40 from being pushed over or past barrier 26, for example during loading and picking.

Figure 11:
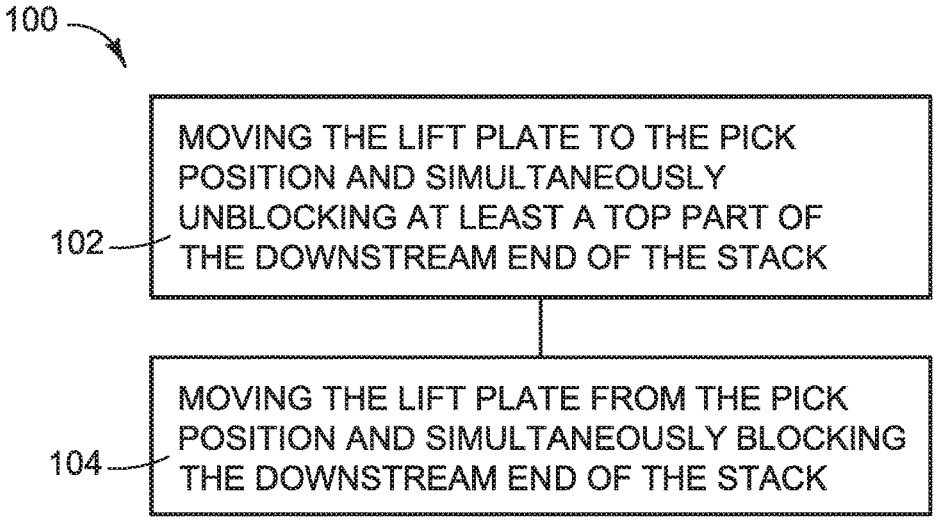
FIG. 11 illustrates an example method for a lift plate type input tray that holds a stack of sheet media for printing.

FIG. 11 illustrates an example method 100 for a lift plate type input tray that holds a stack of sheet media for printing. Method 100 may be implemented, for example, with an example barrier system 14 such as that described above with reference to FIG. 1 and FIGS. 2-10. Referring to FIG. 11, method 100 includes moving the lift plate to a pick position and simultaneously unblocking at least a top part of the downstream end of the sheet stack (block 102) and moving the lift plate from the pick position and simultaneously blocking the downstream end of the stack (block 104).

"A", "an", and "the" as used in the Claims means one or more unless "only one" thing is recited. For example, "an open position" means one or more open positions and subsequent reference to "the open position" means the one or more open positions.

The examples shown in the figures and described above illustrate but do not limit the patent, which is defined in the following Claims.

The invention claimed is:

1. A tray to hold sheet media for printing, the tray comprising:

a movable lift plate to support a stack of media sheets in the tray;

a barrier near a downstream end of the lift plate, the barrier movable between a closed position in which, when the stack of media sheets is on the lift plate, the barrier blocks a downstream end of the stack and an open position in which, when the stack of media sheets is on the lift plate, the barrier does not block a downstream end of at least part of the stack of media sheets, wherein the barrier is a wall positioned between a first sidewall and a second sidewall of the lift plate; and a rack and pinion actuator connected to the barrier and configured to move the barrier from the closed position to the open position when the lift plate moves toward a pick position.

2. The tray of claim 1, comprising a spring urging the barrier toward the closed position.

3. The tray of claim 1, wherein the actuator is configured to move the barrier to the open position when the lift plate moves to the pick position.

4. The tray of claim 3, wherein the actuator is configured to move the barrier to each of multiple open positions when the lift plate moves to each of multiple pick positions.

5. The tray of claim 4, wherein the actuator includes a lever operatively connected to the barrier to move the barrier to the open position when the lever pivots.

6. The tray of claim 5, wherein the lever protrudes from the tray to engage a structure next to the tray and pivot when the lift plate moves to the pick position.

7. The tray of claim 6, wherein the actuator includes:

a pinion that turns when the lever pivots;

a rack that translates when the pinion turns;

a slot in the rack; and a pin in the slot, the pin connected to the barrier to rotate the barrier to the open position when the lever turns the pinion and the pinion translates the rack with the slot.

8. The tray of claim 1, wherein the barrier extends continuously all the way across the downstream end of the lift plate.

9. The tray of claim 1, wherein the barrier includes multiple serrated parts each located near a top of the barrier.

10. A system for a printer, comprising:

a housing;

a removable tray in the housing to hold sheet media for printing, the tray including a movable lift plate to support a stack of media sheets;

a barrier near one end of the lift plate, the barrier movable between a closed position in which, when the stack of media sheets is supported on the lift plate, the barrier completely blocks a downstream end of the stack and an open position in which, when the stack of media sheets is supported on the lift plate, the barrier does not block the downstream end of at least a top part of the stack of media sheets, wherein the barrier is a wall positioned between a first sidewall and a second sidewall of the lift plate; and an actuator having a rack coupled to the housing and a pinion on the tray operatively connected to the barrier, the pinion configured to engage the rack and move the barrier to the open position when the lift plate moves toward a pick position.

11. The system of claim 10, wherein:

the actuator comprises a ramp next to the tray; and the actuator comprises a lever protruding from the tray to engage the ramp and pivot when the lift plate moves toward the pick position.

12. The system of claim 11, comprising a spring urging the barrier toward the closed position.

13. A method for a tray that holds a stack of sheet media for printing, the tray including a lift plate movable to and from a pick position, the method comprising:

moving a barrier, positioned near a downstream end of the lift plate, to an unblocked position to unblock at least a top part of the downstream end of the stack of sheet media while simultaneously moving the lift plate to the pick position, wherein the barrier is a wall that extends from a first sidewall to a second sidewall of the lift plate; and moving the barrier to a blocked position to block the downstream end of the stack of sheet media while simultaneously moving the lift plate away from the pick position.

14. The method of claim 13, wherein unblocking at least a top part of the downstream end of the stack of sheet media comprises completely unblocking the downstream end of the stack of sheet media.

* * * * *